US007247102B2

(12) United States Patent
Hayd

(10) Patent No.: US 7,247,102 B2
(45) Date of Patent: Jul. 24, 2007

(54) GOLF CLUB WITH OPTICAL INDICATING SYSTEM

(76) Inventor: Juan Gerardo Hayd, Carlos Gardel 367-Boulogne, (1609) Buenos Aires (AR)

( * ) Notice: Subject to any disclaimer, the term of this patent is extended or adjusted under 35 U.S.C. 154(b) by 0 days.

(21) Appl. No.: 11/273,721

(22) Filed: Nov. 14, 2005

(65) Prior Publication Data

US 2006/0122006 A1 Jun. 8, 2006

Related U.S. Application Data

(63) Continuation-in-part of application No. 10/962,176, filed on Oct. 8, 2004, now abandoned.

(51) Int. Cl.
*A63B 69/36* (2006.01)

(52) U.S. Cl. ..... 473/236; 473/238; 473/252; 473/242

(58) Field of Classification Search ..... 473/251–254, 473/341, 242, 236, 238; D21/736–746
See application file for complete search history.

(56) References Cited

U.S. PATENT DOCUMENTS

| | | | | | |
|---|---|---|---|---|---|
| D111,855 | S | * | 10/1938 | Moreno | D21/759 |
| 4,000,902 | A | * | 1/1977 | Perkins | 473/251 |
| 4,002,343 | A | * | 1/1977 | Eckert | 473/251 |
| 4,647,045 | A | | 3/1987 | Bilyeu | |
| 4,650,191 | A | * | 3/1987 | Mills | 473/341 |
| 4,688,798 | A | | 8/1987 | Pelz | |
| 4,741,535 | A | * | 5/1988 | Leonhardt | 473/252 |
| 4,824,114 | A | | 4/1989 | Catalano | |
| 4,871,174 | A | * | 10/1989 | Kobayashi | 473/252 |
| D323,867 | S | * | 2/1992 | Rizzotto | D21/740 |
| 5,125,664 | A | * | 6/1992 | Evans | 473/243 |
| 5,362,058 | A | | 11/1994 | Honig | |
| 5,476,262 | A | * | 12/1995 | Bandiero | 473/409 |
| 5,494,282 | A | | 2/1996 | Pranio | |
| 5,595,543 | A | * | 1/1997 | Wolk | 473/162 |
| 5,640,777 | A | | 6/1997 | Densberger | |
| 5,707,299 | A | | 1/1998 | McKenna | |
| 5,810,675 | A | * | 9/1998 | Weathers | 473/236 |
| 5,954,593 | A | | 9/1999 | Benoit | |
| 5,997,409 | A | * | 12/1999 | Mattson | 473/244 |
| D421,471 | S | * | 3/2000 | Moldovan | D21/744 |
| 6,176,791 | B1 | * | 1/2001 | Wright | 473/252 |
| 6,261,190 | B1 | | 7/2001 | Ashcraft | |
| D458,658 | S | * | 6/2002 | Jung | D21/744 |
| 6,482,100 | B1 | * | 11/2002 | Bacon | 473/240 |
| 6,485,375 | B1 | * | 11/2002 | McKinley | 473/245 |
| 6,634,956 | B1 | * | 10/2003 | Pegg | 473/251 |
| 2006/0094521 | A1 | * | 5/2006 | Burns | 473/236 |

* cited by examiner

*Primary Examiner*—Sebastiano Passaniti
(74) *Attorney, Agent, or Firm*—Egbert Law Offices

(57) ABSTRACT

A golf club with optical indicating system includes a head having an elongate planar face defining the hitting surface of the golf club. Above the hitting surface, at least a pair of spaced-parallel forwardly protruding guides are located extending perpendicularly to the hitting surface. The guides define the indicating system that visually helps the player to determine the best path between the position of the ball on the golf green and the hole. The guides may be integral with the body of the club's head or may be separate parts thereof.

4 Claims, 4 Drawing Sheets

GOLF CLUB WITH OPTICAL INDICATING SYSTEM

RELATED U.S. APPLICATIONS

The present application is a continuation-in-part of U.S. patent application Ser. No. 10/962,176 filed on 8 Oct. 2004, and entitled "GOLF CLUB WITH OPTICAL INDICATING SYSTEM", and claiming priority under 35 U.S.C. §120, now abandoned.

STATEMENT REGARDING FEDERALLY SPONSORED RESEARCH OR DEVELOPMENT

Not applicable.

REFERENCE TO MICROFICHE APPENDIX

Not applicable.

FIELD OF THE INVENTION

The present invention generally concerns golf clubs, and particularly golf club heads, and more particularly the head of a golf putter.

The present invention further concerns golf club putter heads incorporating an optical indicating system for helping the user to determine the best place on the club surface to impact the ball. This system comprises a pair of protruding elongated projections that should comply with two basic conditions: 1) they should be located as a part of the club's head in a position higher than the height of the golf ball; and 2) they should be projected forwardly from the planar surface of the club used to hit the ball, without contacting the ball or disturbing the visual contact between the player and the position of the golf ball.

BACKGROUND OF THE INVENTION

It is known to incorporate indicating means to a golf club, and particularly in the head of a putter, in order to help the player to determine the best path and the best position of the putter's head before hitting the ball, considering the location of the ball on the golf green, the distance between the ball and the hole, the inclination (if any) of the golf green, etc.

U.S. Pat. No. 5,362,058 to Honig for PUTTER TRAINING DEVICE describes a training device for use in conjunction with a golf club, includes a rod-like sighting element that can be removably affixed to a golf club in such a way that it extends over the front and back faces of the head of the club. The portion of the sighting element which extends past the hitting face of the club head is upwardly inclined in the direction in which the ball is to be hit. In one embodiment, the device consists of a plastic rod-like element which is attached to a base via an arm. The base is fitted with a magnet to secure it to the metal head of a putter. The arm holds the rod-like element above the head of the putter at an angle which is upwardly inclined in the direction in which the ball is to be hit. The main difference between this invention and the purposed one resides on the fact that this is a training device, that is, is an external element that should be fixed to the golf club's head and the player cannot play a ball on a golf green with this device attached. The present invention is a new golf club head, that is, a new integral head which includes as an integral part thereof the above mentioned indicating means. Moreover this '058 device comprises a single central guide (instead of at least two as in the purposed case) not integral with the club's head, which is not permitted in the official rules of this game.

U.S. Pat. No. 4,688,798 to Pelz for GOLF CLUB AND HEAD INCLUDING ALIGNMENT INDICATORS refers to a putter type golf club alignment system wherein a ball to be struck forms an extension of the alignment indicia on the golf club to provide an indication that the putter head is properly aligned with the ball and the intended target line, including a putter club head, having an upper surface, and a ball striking face wherein the upper surface of the club head is provided with a plurality of simulated golf balls aligned in a row perpendicular to the ball striking face, the simulated balls in use forming a straight line row with the ball to be struck when the putter is properly aligned.

U.S. Pat. No. 5,707,299 to McKenna for a LEVEL INDICATING GOLF PUTTER shows a golf club putter head affixing an elongate spirit level that may be tilted relative to earth and rested on its two frustaconical projections so as to accurately measure earth inclination nonetheless that, inter alia, the sole of the putter head is curved, and thus unsuitable to serve to reference the putter head to the earth's surface. The two frustaconical projections are preferably spaced parallel, equal length, maximally separated and axially weighted. The spirit level is preferably both removably affixed—permitting use of the putter in regulation play—and of maximum elongate extent. A preferably offset hostel is affixed in a position preferably substantially midway between maximally-separated spaced-parallel frustaconical projections.

U.S. Pat. No. 5,640,777 to Densberger et. al. for GOLF CLUB WITH OPTICAL ALIGNMENT SYSTEM is referred to an alignment system and method of use provide significant improvement in the accuracy of a golf stroke or putt. The alignment system may be incorporated into or attached to the head or shaft of a golf club such as a putter or a chipper. One component of the alignment system is a sighting alignment system which includes a turning mirror that is attached to the club head or shaft or may be integral to the top or rear portion of the golf club head. While viewing the reflection of the ball and target through the mirror, the golfer obtains visual feed-back that is very sensitive to club positioning and aiming. The other component is another optical alignment system in which parallax is removed to put the golfer's eye in the proper plane to assure alignment over the golf club head. When both alignments are maintained in the reflected image during the golfer's stroke, the accuracy of the stroke is dramatically improved.

U.S. Pat. No. 6,261,190 to Ashcraft for PUTTER WITH ALIGNMENT FIGURE is referred to a golf club putter that has a putter head including a plurality offset surfaces, each of the offset surfaces containing a respective portion of an alignment figure that has a periphery enclosing an area. Each respective portion of the alignment figure includes respective sections of the periphery. Disorientation of the putter head may be detected by transposition of each portion of the alignment figure with respect to the other portions. Correct orientation of the putter head is indicated by precise alignment of the portions to present the alignment figure without apparent distortion.

U.S. Pat. No. 5,954,593 to Benoit et al. for GOLF PUTTING DEVICE refers to an improved optical putter. The optical putter has a club head whose cross-section is characterized as having four active surfaces: a substantially flat surface for resting the club head upon the green in a first alignment position; a ball-addressing surface; a second, substantially flat, reflective surface for aligning the golf club in a second alignment position; and a substantially flat bottom surface that is substantially perpendicular to the ball-addressing surface. The reflective surface is a semi-circular wedge shape having a sighting line for guiding the golfer to position her or her head and stance. Depending upon the alignment position, the reflecting surface can face upwardly towards the eye of the golfer or towards the cup of the green.

U.S. Pat. No. 5,494,282 to Pranio for GOLF CLUB PUTTER WITH YIPS PREVENTION AND ACCURATE LINE OF SIGHT claims a golf club putter that includes a generally T-shaped club head having a front putting face, a bottom surface, a rear portion of the bottom surface being elevated with respect to a front portion of the bottom surface, and an upper surface having an upward inclination of 7 degrees from a front portion thereof to a rear portion thereof when the club head is addressing a golf ball; a shaft connected to the upper surface of the club head at a rear section thereof; substantially an entire portion of the shaft being oriented forwardly with respect to the club head at an angle of 9 degrees and oriented sidewards with respect to the club head at an angle of about 20 degrees; and the shaft having a length between 33 and 37 inches.

U.S. Pat. No. 4,647,045 to Bilyeu for PUTTER GUIDE claims a putter guide assembly for use with a golf club includes a substantially U-shaped bracket for attaching the guide assembly to the club. The bracket has an upper surface portion serving as a support surface and has opposed free side walls each formed with a mounting hole. A pointing member has a lower surface portion which in use abuts and registers with the upper surface portion of the bracket so as to align the pointing member during use. The pointing member is formed with a tubular ringed end portion disposed between the sidewalls for pivotal attachment to the bracket. A bolt passes through each one of the mounting holes and through the tubular ringed end portion so as to rotatably connect the pointing member to the bracket. The bolt serves as a pivot for the pointing member and further serves as a fastener for securing the guide assembly to the club.

U.S. Pat. No. 4,824,114 to Catalano for GOLF PUTTER WITH SLOPE INDICATING MEANS THEREIN is referred to a golf club putter for use on a golf green for judging the desired path to the cup. The putter comprises a shaft with a putter head secured on one end thereof. The putter has a vertically oriented striking surface for striking a golf ball on swinging movement of the club and a second surface positioned at substantially a right angle to the striking first surface. Level means is supported in the second or right angle surface for indicating the desired angle at which the putter striking surface should strike the ball and the desired curvature of the path of the ball to the cup. The level means comprises a pendulum, recessed in the second, right angle surface, operating as a plumb bob to determine the angle from the horizontal of the putting green. The level means comprises a thin, flat disc-shaped housing mounted in a recess in the second, right angle surface of the putter having a circular rear wall, a circular front wall and a cylindrical side wall. The disc shaped housing has a pivot on which the pendulum is supported and hangs centrally of the housing. The circular front wall is transparent with an opaque coating having a central clear area defining a circular central window through which the pendulum is viewed. A circular indicia on the pendulum of the same size as the window is viewable against the circular edge of said window to indicate the angle and ball path.

U.S. Design Pat. No. D 458,658 of Matt Jung depicts a putter head including two L-shaped rod-type protruding indicators means extending upwardly at each side of the hitting surface of the club's head. The basic difference between this design and the present invention resides on the fact that the indicators can be taken out when the player considers necessary, for example if this type of indicator systems are not authorized for Official tournaments. The '658 design does not offer this possibility as the rods are integral part of the club's.

U.S. Design Pat. No. D 323,867 of Bennie Rizzotto depicts a golf putter head including two longitudinal grooves on the upper side of the club's head that offers to the player a visual indication of the potential path between the ball and the club. But the main difference between this design and the present case resides on the indicators means per se, since in the '867 case it only consists on a couple of lines that are not very noticeable from above, instead the present case the indicators are two protruding parts extending upwardly and forwardly from the club's head offering to the player a more clear indication of said path.

Finally, U.S. Design Pat. No. D 421,471 depicts a free standing gold putter head including several longitudinal grooves on the upper head of the club's head. This case is similar to the previous one, which only offers to the player a couple of lines not very visible from above.

None of the above cited patents comprise a putter head with indicating means integral with the body of said club head. There are some other patents referred to golf putters including more sophisticated means for helping to the player with the path, for example by using laser lights. Just as an example, the following U.S. patents may be cited: U.S. Pat. Nos. 6,123,626; 5,980,393; 5,725,440; 5,611,739; 5,465,972; 5,464,222 and 5,388,831 between others. These patents are only cited as a reference. They are referred to very sophisticated and expensive devices using the capability of the laser light of staying always on a straight path, thus helping to the player to determine the correct path to the hole. But these kinds of devices cannot be used during a tournament and their use is restricted to practicing.

BRIEF SUMMARY OF THE INVENTION

The present invention is referred to a novel golf club, particularly to a golf putter that includes an indication system that helps the player to determine the virtual path between the ball and the hole, and which is the best part of the head to hit the ball considering the position of the ball on the golf green, the slope of the golf green, the length of the path between the ball and the hole, etc. This indication system comprises at least two protruding elongated guides extended forwardly from the planar face of the head, without interfering with the hitting surface of the club head because these guides are located above said surface. Thus, the player that is looking at the ball from above may see the ball, the club head and the guides that indicate, for example, where the center of the hitting surface is. These guides may be integral with the club's head and may also be used to help the player to adjust the path that the ball should follow for entering the hole in a single hit. The player may locate the club's head behind the ball and use the above cited guides to align the ball with the hole and thus determine the better path and a hit strategy. In another embodiment said guides can be fit in the club's head as a separate part thereof, as will be explained later.

Summing up, the present invention is referred to golf club with optical indicating system, said golf club comprising a head having an elongate planar face defining the hitting surface of the golf club, above said surface at least a pair of spaced-parallel forwardly protruding guides are located extending perpendicularly to the hitting surface. Said guides may be integral with the body of said club's head or may be separate parts that can be fit in the head upper surface when the player considers appropriate.

DETAILED DESCRIPTION OF THE INVENTION

Figure 1:
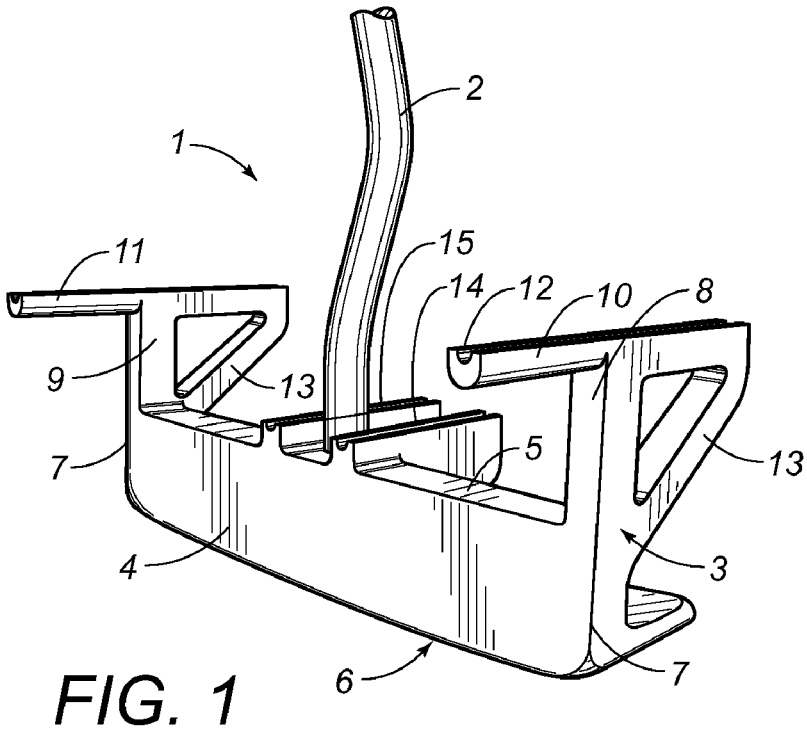
FIG. 1 is a diagrammatic perspective view showing a preferred embodiment of the golf club in accordance with the present invention including two pair of guides, the first one on the ends of the hitting surface and the second one at the center of said surface, with the club's rod in between. From this view the forwardly position of the guides may clearly be seen, and this is one of the most important features of this invention, said guides are projected forwardly from above the hitting surface.
Figure 2:
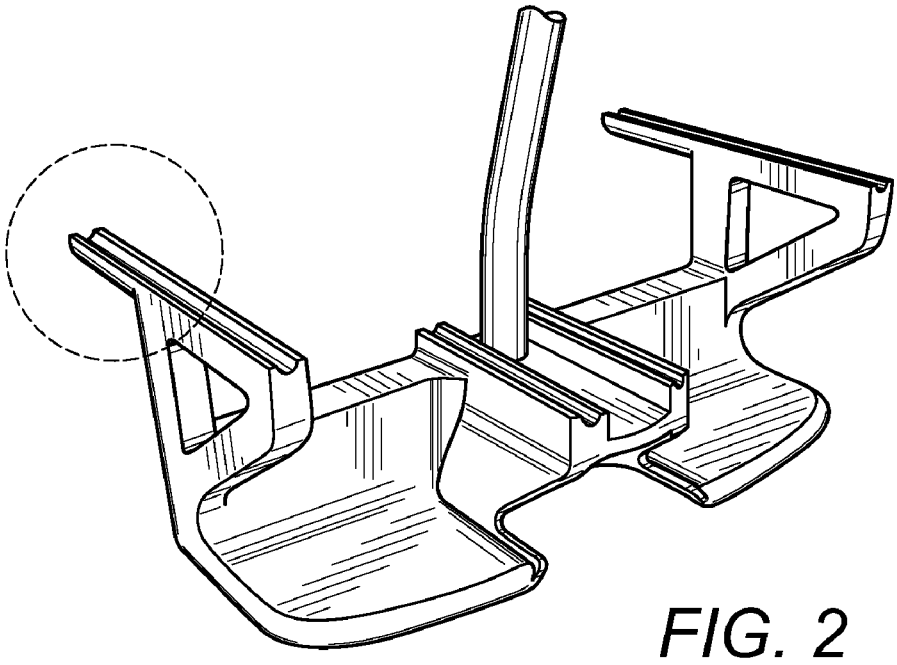
FIG. 2 is another perspective view of the club head illustrated in FIG. 1, in this case from the opposite side, that is behind the hitting surface.

A preferred embodiment is illustrated in FIGS. 1-2. The golf club 1 includes, as usual, a rod 2 and a head 3. Said head 3 includes an elongate planar face 4 defining the hitting surface of the golf club, having two elongated upper and lower sides 5-6 and two short lateral sides 7. Between said sides 5-6-7 the planar rectangular surface 4 is formed. From said sides 7 a pair of columns 8-9 are projected upwardly at the end of which respective perpendicular elongated guides 10-11 are located. Said surface 4, the columns 8-9 and the guides 10-11 are integral with the rest of the head 3 complying with the rules of the Golf Association. In the embodiment depicted in FIGS. 1-2 each guide 10-11 is formed by an elongated U-shaped solid rod with a longitudinal notch 12 on its upper side. Said notch defines a visual indication for the player that looks the ball from above when is ready to hit it. Between the rear end of said guides 10-11 and the upper end of columns 8-9 a reinforcing diagonal rib 13 is located to bring more structural consistency to the head 3.

Thus the golf club of the present invention comprises a golf club comprising a head 3 having an elongate planar face 4 defining the hitting surface of the golf club. Above said surface 4 and integral with the body of the club's head 3 at least a pair of spaced-parallel forwardly protruding guides 10-11 are located extending perpendicularly to the hitting surface 4. Said guides 10-11 are located at the respective ends 7 of said hitting surface 4 of the club's head 3. In the embodiment of FIGS. 1-2 said head 3 includes two pair of guides, one pair located at the respective ends 7 of said hitting surface 4 and the second pair of guides 14-15 are located on the upper side 5 side by side with the lower end of rod 2.

Figure 3:
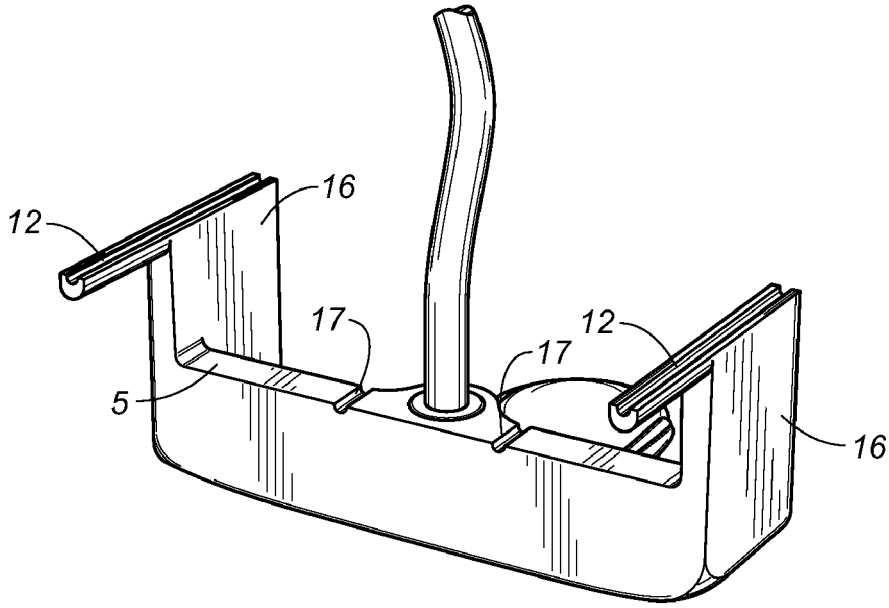
FIG. 3 illustrates another perspective view of an alternative embodiment of the present invention, in which the head includes two pair of guides but one of them is defined by a pair of elongated rods and the other pair is defined by a pair of notches.

In the embodiment illustrated in FIG. 3 the above described columns 8-9 and diagonal ribs 13 are replaced by a solid wall 16 and the central guides 14-15 are replaced by a pair of notches 17 etched on side 5.

Figure 4:
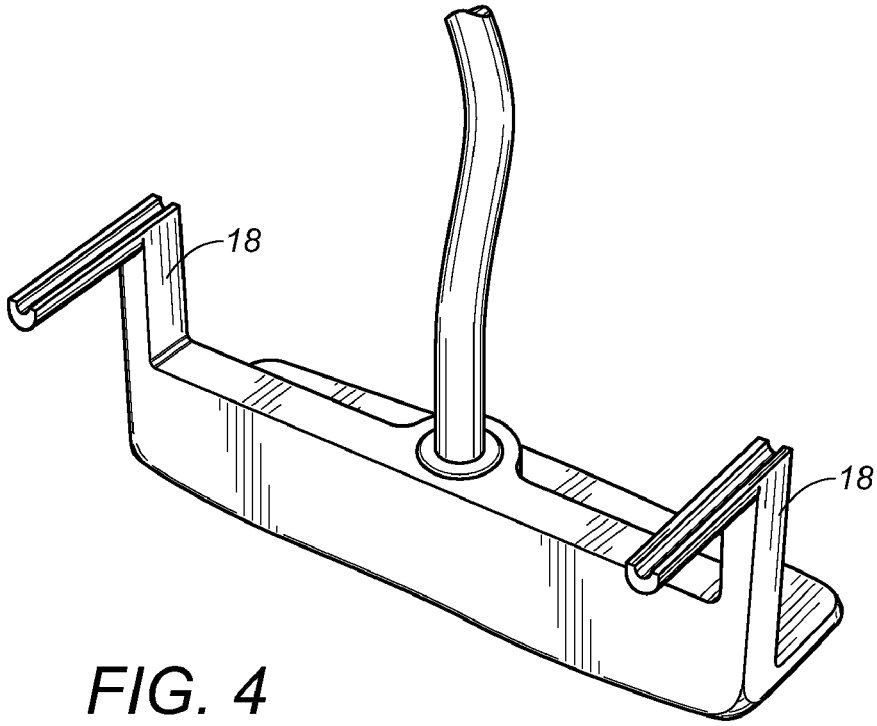
FIG. 4 is another diagrammatic perspective view showing another preferred embodiment in which the head includes only one pair of guides, located at the respective ends of said hitting surface.

FIG. 4 illustrates another embodiment in which there is only one pair of guides 10-11 bonded to the body of head 3 by a single column 18.

Figure 5A:
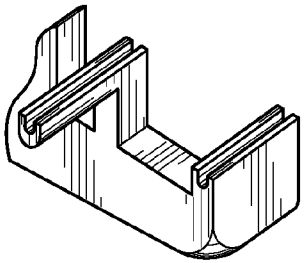
FIGS. 5A-5F illustrate perspective views of different embodiments for guide shapes and arrangements as will be explained in more detail below.
Figure 5B:
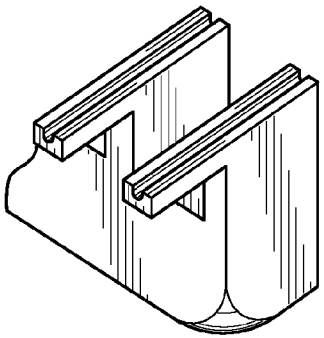
Figure 5C:
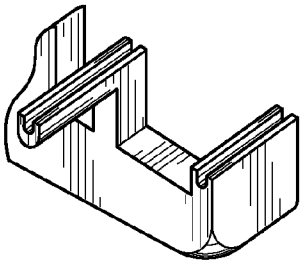
Figure 5D:
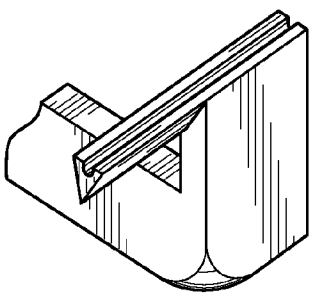
Figure 5E:
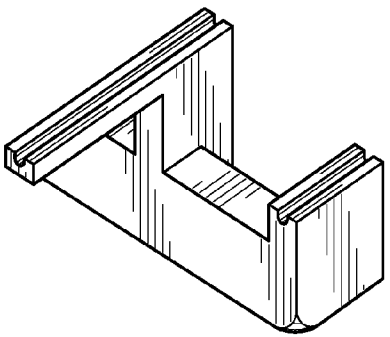
Figure 5F:
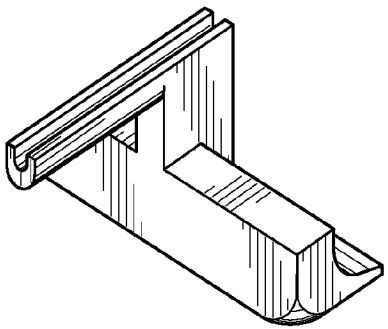

FIGS. 5A to 5F are different embodiments of guides 10-11. For clarification purposes only one half of the club's head is illustrated in each case. There are several combinations of guides. FIGS. 5A, 5B, and 5E illustrate different combinations of pairs of guides, FIG. 5C depicts a cylindrical guide, FIG. 5D a triangular-cross-shaped guide and 5F a half-rounded elongated guide.

Figure 6A:
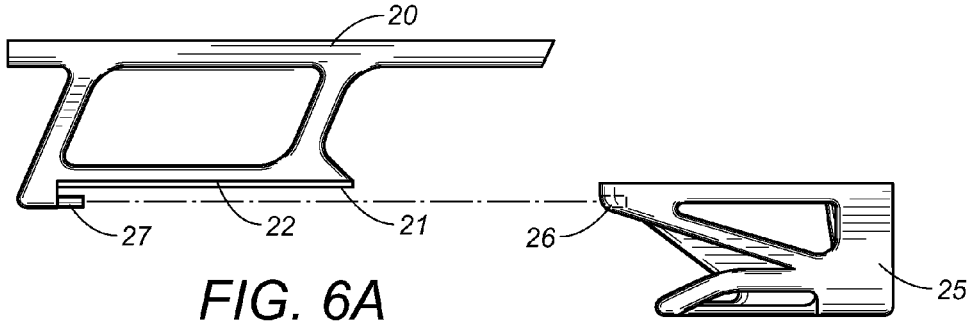
FIGS. 6A-6C are respective perspective views of another embodiment in which the guides are separate parts that can be fit on the upper surface of the club's head.
Figure 6B:
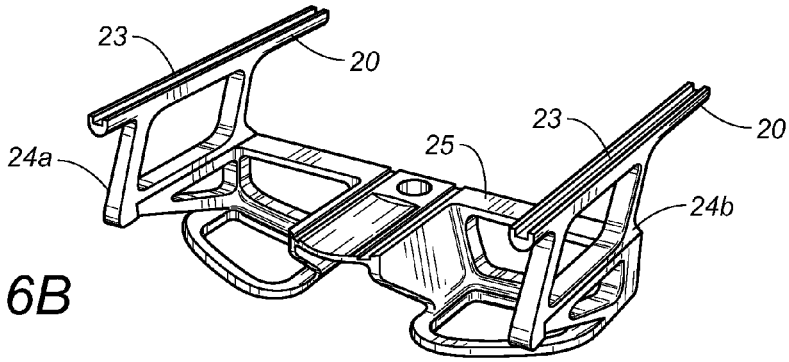
Figure 6C:
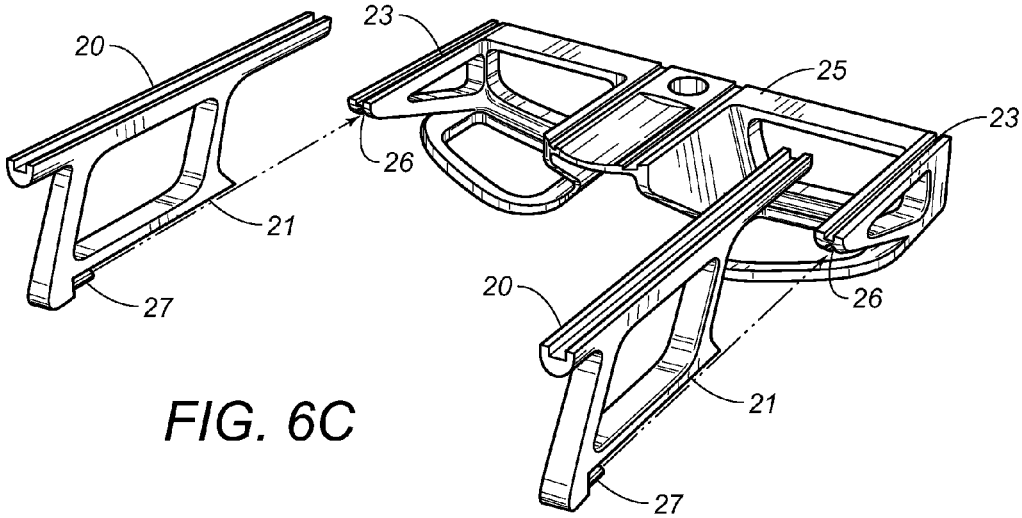

In FIGS. 6A-6C a new embodiment is depicted in which the guides are separate parts of the club's head instead of an integral part thereof as in the previous embodiment. FIG. 6A shows a perspective view of a club's head with the guides in a separate position. In this case each guide, indicated with the numeral reference 20, has the same shape as in the previous embodiment but in this case the lower end 21 includes a longitudinal rib 22 which shape has a complementary shape with the shape of a groove 23 included at each side 24*a*-24*b* of the club's head 25. At the front end of said rib 22 there is a locking pin 27 that when the guide is fit in the club's head is lodged in an orifice 26. Thus, these guides may be put in operative position when the player decides to do so. For example, if these guides are objected by the Authorities of a Golf Club in which the player is playing a tournament, he may take them off by a smooth sliding of the rib 22 in the grooves 24*a-b*.

Finally it should also be considered that the length of each guide and its height have no relevance in the final result of helping the golfer to determine the virtual path between the ball and the hole.

I claim:

1. A golf club having an optical indicating system, the golf club comprising:

a head having an elongate planar face defining a ball hitting surface thereon, said planar face having an upper side and a lower side and a pair of lateral sides extending between said upper side and said lower side;

a shaft connected to said head at a center of said upper side, said shaft extending upwardly from said head;

a pair of elongate guides affixed to said head, said pair of elongate guides arranged in spaced parallel relation to each other, each of said pair of elongate guides having a portion extending forwardly of said planar face and a portion extending rearwardly of said planar face, said pair of elongate guides extending in transverse relation of said planar face, each of said pair of elongate guides positioned entirely above said upper side of said head, each of said pair of elongate guides extending perpendicular to said upper side of said head, each of said pair of elongate guides connected to said head by a rib extending from a lower side of the elongate guide, each of said pair of elongate guides having a longitudinal groove formed on an upper surface thereof.

2. The golf club of claim 1, said pair of elongate guides respectively positioned at said pair of lateral sides of said head, the golf club further comprising:

another pair of guides positioned adjacent to and on respective opposite sides of said shaft, said another pair of guides formed adjacent to said upper side of said head.

3. The golf club of claim 1, each of pair of elongate guides having a rectangular cross-section, said longitudinal groove extending for an entire length of the elongate guide.

4. The golf club of claim 1, said pair of elongate guides being integral with said head.

* * * * *